United States Patent [19]

Dabonde

[11] Patent Number: 4,537,112

[45] Date of Patent: Aug. 27, 1985

[54] CARTRIDGE DECAPPING TOOL

[76] Inventor: James T. Dabonde, P.O. Box 502, Gympie, Queensland, Australia

[21] Appl. No.: 577,678

[22] Filed: Feb. 7, 1984

[51] Int. Cl.[3] ..... F42B 33/04; F42B 33/10

[52] U.S. Cl. ..... 86/37; 29/252; 86/24; 86/36

[58] Field of Search ..... 86/36, 37, 38, 25, 28, 86/19, 24, 23; 29/252; 81/3.2

[56] References Cited

U.S. PATENT DOCUMENTS 3,982,465 9/1976 Schabauer ..... 86/36

FOREIGN PATENT DOCUMENTS 0563930 11/1932 Fed. Rep. of Germany ..... 86/36

*Primary Examiner*—Stephen J. Lechert, Jr.
*Assistant Examiner*—Howard J. Locker

[57] ABSTRACT

A decapping tool applicable to Berdan style cartridges operative to hydraulically eject primer caps from spent cartridge cases and useful with standard shooter's reloading presses to communicate pressurized fluid via a necked tool sealingly contacting spent cases at the inner surface around the primer cap recess to communicate thereto impulsive fluid pressures generated by a struck piston at a remote end of said tool.

4 Claims, 1 Drawing Figure

CARTRIDGE DECAPPING TOOL

This invention relates to gun cartridge reloading and more particularly to a means by which primer caps may be removed from spent cartridge cases.

BACKGROUND OF THE INVENTION

The cost of gun ammunition is such that regular shooters may profitably look at reloading spent cartridge cases, which process may be done at something like a quarter of the cost of purchasing proprietary loaded ammunition. Normal sporting ammunition is Boxer primed with a single center flash hole making the removal of the primer cap an easy task. A removal tool may be fed from inside the empty cartridge case, through the flash hole, to engage the primer cap and force it out using the usual shooter's reloading press and appropriate tooling therein. However, all the world's armies except American, use Berdan primers, with two small, off center flash holes, making it impossible to remove the primer using the normal decapping tooling. Australian military brass employs a Berdan primer, pressed home and roll crimped into place. The removal of the primer cap from this type of cartridge is a difficult exercise.

The most common method of depriming Berdan cartridges has been to dig out the primer with a small chisel. However, difficulties arise in supporting the cartridge case without crushing it whilst the chisel is at work, and avoiding damaging the shoulder around the primer hole in the cartridge whose construction is out of brass and therefore readily damaged. This method can also set back the shoulder in the case thereby creating excessive headspace in the rifle.

Another known technique for removing primer caps from spent Berdan cartridges employs hydraulic pressure. In the simplest form, this technique uses a hand set type of reloader's bullet seating die as a decapper. The fired case is slipped into the body of the die. The base of the case is fitted to the body of the die and an access hole filled with water. The bullet seating stem is quickly placed into the die and given a smart hit with a mallet. The case thus removed is then dried either by heating or by using methylated spirits. However this method of removal has not been useful, being often messy to operate, or slow in operation, such that the process is awkward to employ.

Another known depriming technique employs a Boxer primer on the end of a rod held at the base of the cartridge over the two flash holes. Ignition of the Boxer primer can blow out a Berdan primer.

To date no tooling exists whereby Berdan style ammunition may be quickly and efficiently deprimed for reloading in a manner which is guaranteed not to damage the cartridge case and is simple in its operation.

BRIEF SUMMARY OF THE INVENTION

The present invention aims at providing a simple mechanism which may be used to effect depriming of Berdan and other like cartridges. A further object of the present invention is to provide a mechanism for removing primer caps from Berdan and other like cartridges which performs its function reliably with no damage to the brass cartridges. A still further object of the present invention is a mechanism for removal of primer caps from spent cartridges which is quick operating so that a fast rate of cartridge depriming can be achieved. Another object of the present invention is to provide a mechanism for primer removal which may be used in conjunction with tools forming part of a standard reloader's kit.

An additional object of the present invention is a mechanism for primer removal which is effective in achieving primer removal in roll crimped Berdan style cartridges. Other objects and advantages of the present invention will hereinafter become apparent.

The invention provides a primer cap removing device for decapping spent cartridge cases to enable their reloading, said device to be used with a mounting mechanism by which a cartridge to be decapped of its spent primer may be supported in a manner which enables access to the inside volume of the spent cartridge case and also enables unimpeded movement of the primer cap away from the cartridge on its ejection therefrom comprising a tubular means for communicating at a first end thereof with the base of a cartridge to sealingly contact against said base and communicate pressurised fluid thereto from a source of said fluid, said tubular means first end being dimensioned so as to overlie the cartridge case flash hole, or holes, in the cartridge base, a support means for said device operative with said mounting mechanism to hold said first end sealingly against said cartridge case base during decapping, and a source of pressurised fluid connected thereto at the end opposite said first end.

BRIEF DESCRIPTION OF THE DRAWINGS

In order that the invention may be more readily understood and put into practical effect, reference will now be made to the accompanying drawing which illustrates a preferred embodiment thereof and wherein.

DETAILED DESCRIPTION

Figure 1:
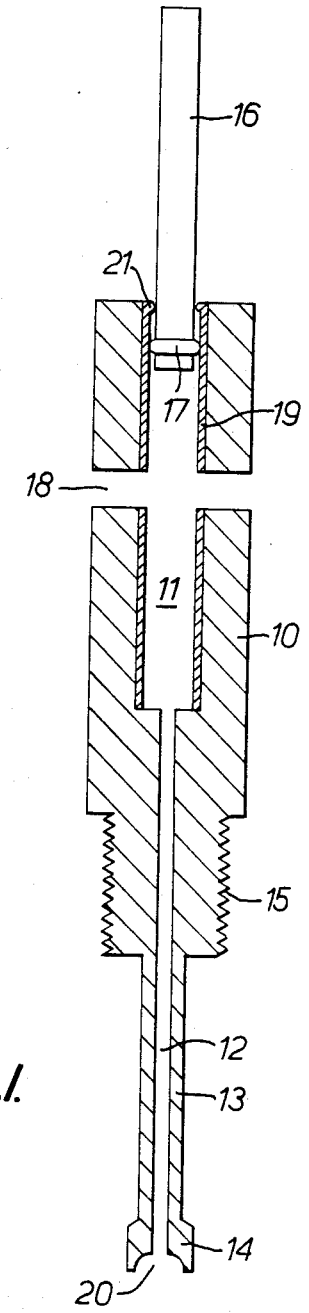
FIG. 1 is a schematic cross-section through a tool suitable for application to cartridge depriming in accordance with the present invention.

FIG. 1 is a cross-section through a tool which may be screwed into a standard cartridge resizing tooling of a standard shooter's reloading press to press the end 20 of the tool down onto the base of a Berdan primed cartridge over the flash holes therethrough when the cartridge is mounted in the press and the press is closed. The press is used to hold the depriming tool end 20 against the cartridge base or bottom to maintain a seal therewith. The tool may be a tubular construction produced largely by metal turning.

The cartridge depriming tool of FIG. 1 comprises a body portion 10 having a central bore 11 into which a suitable fluid such as water may be filled through slots 18. The dimensions of the central bore 11 are determined by the hydraulic requirements to ensure sufficient pressure at the bottom opening in tool end 20 to remove a cap. The slots 18 may be simply produced by cutting grooves into the tool body 10 at opposite sides thereof of a depth to extend to the internal bore 11 for communication therewith. Such grooves may be cut by a cutting disc comprised of a suitable cutting material in a binder. A tubular tool, slotted on opposite sides results in the cross-section indicated in FIG. 1. The slots enable filling the tool with water, or other suitable fluid, using a suitable pouring device. The central bore 11 is fitted with a piston 16 having a suitable sealing means fitted thereto. Suitable sealing may be provided by an O ring seal as indicated at 17.

Withdrawal of the piston rearwardly to the position shown in the drawing permits water or other suitable fluids to be introduced to the tool up to the level of the slots. When the tool bottom 20 engages the base of the cartridge case, the tool's piston protruding end may be hit with a hammer, or other suitable means for applying an impulsive force or pressure to in turn produce an hydraulic pressure in the tube 12 which is passed by the flash holes to the primer cap to eject the cap from the cartridge end.

The end portion 20 of the tube 12 is formed with a recess at its bottom as shown in the drawing, the recess being contoured to receive therein the anvil of Berdan or Berdan-like cartridges and to seal therearound and against the cartridge case base so that hydraulic pressure developed in the tool be fed along the tube 12 to end portion 20 to apply pressure through the primer holes to the primer cap to eject it on operation of the tool. A small bore 13 is employed in tube 12 to conserve water as is hereinafter described.

In order to ensure proper sealing of the O ring seal 17 during movement of the piston 16, the bore 11 of the body 10 is provided with a sleeve of suitable material such as brass as indicated at 19. The end 21 of the sleeve may be rolled inwardly to produce a rim which prevents the O ring seal 17 on the piston 16 from moving out of the end of the bore, so that damage to the seal which might occur on its reinsertion if withdrawn from the bore, does not occur. The tool body 10 may be provided with a threaded shank 15 to enable threaded connection with the standard press tooling. It is possible to employ the tool of the invention in standard resizing dies in place of the Boxer primer removal tool when operating on Berdan cartridges. Alternatively, the depriming tool of the invention might be screwed into the press directly without any resizing tooling being simultaneously operated.

The tube 12 of the tool may carry a widened end portion 14 having the proper external diameter for end portion 14 to operate as the cartridge neck resizing tool so as to resize a cartridge neck on withdrawal of the cartridge once the primer cap has been removed. The external dimension of the tube 12 is determined by the size of the cartridge case opening into which the tool's tube is to be inserted. The internal bore 13 is sized so that little water, etc., will flow therethrough on the device being fitted to another cartridge case for use as described below.

The tool of the present invention has an internal volume sufficient to hold only about a teaspoon of water, the internal bore 13 of the tool may be so small that little if any water flows out of the tube on removal of the primer, enabling reloading of the press or other support mechanism with another spent cartridge case and removal of its primer, a number of times before the tool needs be refilled with water. The primer removal tool may be received in the cartridge resizing dies normally used with standard loading presses in which case operation of the reloading press to resize the cartridge also enables decapping of the cartridge. Most common makes of reloader's press have a closed, over centre locking position to lock the press in its closed position which remains in its closed position notwithstanding the considerable force applied during operation of the decapping tool, without the press springing open from its closed position. As stated above it is possible to operate the decapping or depriming tool without simultaneous use of resizing dies, it only being required that the tube 20 have a length to ensure firm engagement with the cartridge base or bottom when the press or other support mechanism is closed.

The tool of the invention is effective to remove caps which are both stab and roll crimped brass. The primers are expelled with great force and consideration should be given to use of suitable deflectors to catch the expelled caps to prevent damage to tooling or injury to operators. The simplest expedient is the draping of a screen of heavy duty, flexible, deflective material over the outlet from which the caps are ejected. A thick rubber mat on a suitable connector is suitable in most applications.

The above described tool might be used with the piston induced an hydraulic impulse for primer removal. Alternatively, the bore of the tool might be supplied with a remote source of hydraulic pressure. The hydraulic fluid used is preferably non-compressible, such as water and hydraulic oils, but for ease of operation water is preferred as the cartridges are simply dried after depriming and no expensive fluid such as hydraulic oil is wasted.

The tool of the present invention may screw into a cartridge resizing die, replacing the customary shaft and resizing button normally used with the cartridge resizing die. The neck conveys the pressure to the cartridge base.

The tool of the present invention is susceptible to automatic operation by providing a simple automatic tool filling device to supply the hydraulic or pressure fluid, and an automatic striking mechanism to deliver the impulses where an impulsive type hydraulic force is employed. Alternatively a pressurised source might be used. As to the pressure or impulsive force required, this is a function of the relative size of the piston to the tool end face.

While the above has been given by way of illustrative example, many modifications and variations as would be apparent to persons skilled in the art may be made thereto without departing from the broad scope and ambit of the invention as herein set forth and claimed in the following claims:

1. A Berdan primer cap removing tool for decapping a spent Berdan primed cartridge case, having flash hole means in the base thereof, to enable reloading of the cartridge case, comprising a tubular means for communicating at a first end thereof with the inside of the base of a cartridge to sealingly contact against said base and communicate pressurized fluid thereto from a source of said fluid, said tubular means first end being dimensioned to overlie said flash hole means, said first end of said tubular means being adapted to be sealingly held against said cartridge case base during decapping, the improvement comprising in that said source of pressurized fluid comprises a cylinder body and a piston reciprocably movable therein, means for feeding a working fluid within said cylinder body, said piston having a striking surface extending externally of said cylinder body which when struck acts on said working fluid to impulsively communicate pressurized fluid to the primer cap to be removed, said cylinder body being formed with a bore of predetermined size, said cylinder body having an axially extending cylindrical tubular part adapted to be received in the cartridge case and having a bore in communication with the bore in the cylindrical body, said tubular part having a diameter and bore size smaller than the diameter and bore size of the cylindrical body, said first end of the tubular means comprising the free end of the tubular part extension of the cylindrical body, said cylindrical body having a threaded portion adapted for threaded engagement with a standard shooter's device for sealingly engaging said first end of the tubular means with the cartridge base, said first end of the tubular means having resizing means for resizing the cartridge on removing the axially extending tubular part from the cartridge case after decapping thereof.

2. A device as claimed in claim 1, wherein a screen means is provided for deflecting ejected primer caps.

3. A device as claimed in claim 1, wherein said bore in said axially extending tubular part comprises a narrow bore to restrict fluid drainage therethrough.

4. A device as claimed in claim 1, wherein said first end of said tubular means is provided with a recess in the end face thereof which overlies and receives therein a primer cap recess in the base of a cartridge case to be decapped thereby, said first end being shaped to engage said base all around the circumference of said primer cap recess so as to communicate pressurized fluid through the case flash hole means to said primer cap via said tubular means.

* * * * *